US011367339B2

(12) United States Patent
Vannebo

(10) Patent No.: US 11,367,339 B2
(45) Date of Patent: Jun. 21, 2022

(54) SYSTEM AND METHOD FOR STARTUP OF A DETECTOR LOOP

(71) Applicant: Autronica Fire & Security AS, Trondheim (NO)

(72) Inventor: Per Johan Vannebo, Trondheim (NO)

(73) Assignee: AUTRONICA FIRE & SECURITY AS, Trondheim (NO)

( * ) Notice: Subject to any disclaimer, the term of this patent is extended or adjusted under 35 U.S.C. 154(b) by 0 days.

(21) Appl. No.: 17/252,380

(22) PCT Filed: Jun. 21, 2018

(86) PCT No.: PCT/EP2018/066678

§ 371 (c)(1),
(2) Date: Dec. 15, 2020

(87) PCT Pub. No.: WO2019/242863

PCT Pub. Date: Dec. 26, 2019

(65) Prior Publication Data

US 2021/0192926 A1 Jun. 24, 2021

(51) Int. Cl.
*G08B 25/04* (2006.01)
*G08B 17/06* (2006.01)

(52) U.S. Cl.
CPC ..... *G08B 25/045* (2013.01); *G08B 17/06* (2013.01)

(58) Field of Classification Search
CPC ..... G08B 25/045; G08B 17/06; G08B 25/04
USPC ..... 340/292
See application file for complete search history.

(56) References Cited

U.S. PATENT DOCUMENTS

| | | | |
|---|---|---|---|
| 3,813,662 | A | 5/1974 | Lewis |
| 3,927,404 | A | 12/1975 | Cooper |
| 4,079,363 | A | 3/1978 | Wilson, Jr. |
| 4,528,610 | A | 7/1985 | Payne |
| 4,849,734 | A | 7/1989 | Williamson |

(Continued)

FOREIGN PATENT DOCUMENTS

| | | | |
|---|---|---|---|
| DE | 3637681 | A1 | 5/1988 |
| EP | 0093872 | A1 | 11/1983 |

(Continued)

OTHER PUBLICATIONS

ISR/WO for Application No. PCT/EP2018/066678; dated Mar. 11, 2019; 15 pages.

(Continued)

*Primary Examiner* — Joseph H Feild
*Assistant Examiner* — Sharmin Akhter
(74) *Attorney, Agent, or Firm* — Cantor Colburn LLP

(57) ABSTRACT

Disclosed is a hazard detector connected to a circuit that has: a plurality of circuit ends and a plurality of detectors, wherein the detector is connected intermediate the plurality of circuit ends, a circuit driver connected to the plurality of circuit ends so that the circuit forms a loop circuit, the circuit driver controlling one or more power sources to selectively provide power to the first circuit end and the second circuit end, and the detector has a short isolator switch that, when opened, breaks electrical continuity downstream of the detector, wherein the detector scans for a short at startup by receiving power, closing the switch, measuring one or more circuit parameters, and determining whether there is a short based on the one or more parameters.

18 Claims, 7 Drawing Sheets

(56) References Cited

U.S. PATENT DOCUMENTS

| | | | | |
|---|---|---|---|---|
| 4,954,809 | A | 9/1990 | Right et al. | |
| 4,956,634 | A | 9/1990 | Right | |
| 5,461,370 | A | 10/1995 | Igarashi et al. | |
| 5,721,530 | A | 2/1998 | Right et al. | |
| 6,777,951 | B2 | 8/2004 | Marino et al. | |
| 8,299,911 | B2 | 10/2012 | Buss | |
| 8,446,285 | B2 | 5/2013 | Lontka | |
| 8,553,565 | B2 | 10/2013 | Kamachi et al. | |
| 8,902,063 | B2 | 12/2014 | Auger et al. | |
| 9,552,720 | B2 | 1/2017 | Moffa | |
| 9,633,554 | B1 | 4/2017 | Barson | |
| 2017/0061756 | A1* | 3/2017 | Kim | G08B 25/08 |

FOREIGN PATENT DOCUMENTS

| | | | | |
|---|---|---|---|---|
| EP | 0347806 | A1 | 12/1989 | |
| EP | 0532787 | A1 | 3/1993 | |
| EP | 1109143 | B1 | 6/2004 | |
| EP | 1363261 | B1 | 9/2004 | |
| EP | 2706518 | A1 | 3/2014 | |
| EP | 2833333 | A1 * | 2/2015 | G08B 25/04 |
| EP | 2833333 | A1 | 2/2015 | |
| EP | 2437228 | B1 | 8/2016 | |
| EP | 3038069 | B1 | 4/2017 | |
| GB | 2168517 | A | 6/1986 | |
| GB | 2484288 | A | 4/2012 | |
| WO | 8705731 | A1 | 9/1987 | |

OTHER PUBLICATIONS

Siemens; "OH320A Multisensor Smoke Detector"; 2003; Siemens Building Technologies AG; 4 pages.

* cited by examiner

SYSTEM AND METHOD FOR STARTUP OF A DETECTOR LOOP

CROSS REFERENCE TO RELATED APPLICATIONS

This is a US National Stage of Application No. PCT/EP2018/066678, filed on Jun. 21, 2018, the disclosure of which is incorporated herein by reference.

BACKGROUND

Exemplary embodiments pertain to the art of detector loops and more specifically to a system and method for startup of a detector loop.

A traditional detector loop with many loop units (for example, more than one hundred loop units) may take many minutes to start. The process may involve consecutively starting each loop unit and having each loop unit test for a short circuit in the loop. Each unit, one at a time, may power up, identify itself, and test for a short circuit by closing an on-board short circuit isolator switch. Due to a relatively low loop communication speeds, this may be a time-consuming procedure.

BRIEF DESCRIPTION

Disclosed is a hazard detector electrically connected to a circuit, wherein the circuit includes: a plurality of circuit ends including a first end and a second end, and a plurality of detectors including the detector, wherein the detector is connected intermediate the plurality of circuit ends, a circuit driver connected to the plurality of circuit ends so that the circuit forms a loop circuit, the circuit driver including a first controller controlling one or more power sources to selectively provide power to the first end and the second end, and the detector comprising a second controller and a switch which is a short isolator switch that, when opened, breaks electrical continuity downstream of the detector, wherein the detector scans for a short at startup by receiving power, closing the switch, measuring one or more circuit parameters, and determining whether there is a short based on the one or more parameters, when there is a short, the detector transmits a first circuit communication that identifies the short.

In addition to one or more of the above features or as an alternate the detector when powered provides status by receiving a second circuit communication requesting an amount of elapsed time since receiving power and a unique detector identifier, and transmitting a third circuit communication responsive to the second circuit communication, including the amount of elapsed time and the unique detector identifier.

Further disclosed is a circuit comprising: a plurality of circuit ends including a first end and a second end, and a plurality of detectors including the above disclosed detector connected intermediate the plurality of circuit ends, a circuit driver connected to the plurality of circuit ends so that the circuit forms a loop circuit, the circuit driver including a first controller controlling one or more power sources to selectively provide power to the first end and the second end, and wherein the circuit driver scans circuit continuity during startup by: transmitting power to the first end, monitoring the second end, and when the circuit driver senses power at the second end, the circuit driver determines continuity exists.

In addition to one or more of the above features or as an alternate when the circuit driver determines continuity exists, the circuit driver maps circuit topology by: transmitting the second circuit communication from the first end, requesting from the plurality of detectors the amount of elapsed time since receiving power and the unique identifier for the detector, receiving, from each of the plurality of detectors, the third circuit communication responsive to the second circuit communication, including the amount of elapsed time and the unique detector identifier, and mapping circuit topology based on the unique detector identifiers and the elapsed time since receiving power.

In addition to one or more of the above features or as an alternate the circuit driver detects circuit discontinuity at startup by receiving the first circuit communication at the first end from the detector, thereby determining there is a circuit short, or failing to receive a circuit communication or sense power at the second end within a predetermined period of time, thereby determining there is a circuit break.

In addition to one or more of the above features or as an alternate when there is a circuit discontinuity, the circuit driver maps a first segment topology of the circuit from the first end to the circuit discontinuity by transmitting the second circuit communication, requesting the amount of elapsed time since receiving power and the unique detector identifier, receiving the third circuit communication responsive to the second circuit communication, including the amount of elapsed time and the unique detector identifier and mapping the first segment topology of the circuit between the first end and the discontinuity based the unique detector identifiers and the elapsed time since receiving power from the first end.

In addition to one or more of the above features or as an alternate when there is a circuit discontinuity, the circuit driver maps a second segment topology of the circuit from the second end to the circuit discontinuity, by transmitting power to the second end, detecting circuit discontinuity through the second end by receiving the first circuit communication at the second end from a second detector, thereby confirming there is a circuit short, and failing to receive a circuit communication within a predetermined period of time, thereby confirming there is a circuit break, transmitting the second circuit communication, requesting the amount of elapsed time since receiving power and the unique detector identifier, receiving the third circuit communication responsive to the second circuit communication, including the amount of elapsed time and the unique detector identifier, and mapping the second segment topology of the circuit between the second end and the discontinuity based the unique detector identifiers and the elapsed time since receiving power from the second end.

In addition to one or more of the above features or as an alternate the circuit driver determines a location of the circuit discontinuity combining the mapped first segment topology and mapped second segment topology of the circuit.

In addition to one or more of the above features or as an alternate the detector acknowledges receiving power at startup by issuing an acknowledgment pulse to the circuit.

In addition to one or more of the above features or as an alternate the detector scans for a circuit break at startup by failing to receive an acknowledgement pulse within a predetermined period of time.

Further disclosed is a method of scanning for a short at startup by a hazard detector electrically connected to a circuit, the circuit including one or more of the above disclosed features. Yet further disclosed is method of scanning circuit continuity at startup by a circuit driver electrically connected to a circuit, the circuit including one or more of the above disclosed features. Further disclosed is a method of acknowledging receiving power at startup by hazard detector electrically connected to a circuit, the circuit including one or more of the above disclosed features. Yet further disclosed is a method of detecting continuity by a circuit driver electrically connected to a circuit, the circuit including one or more of the above disclosed features.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
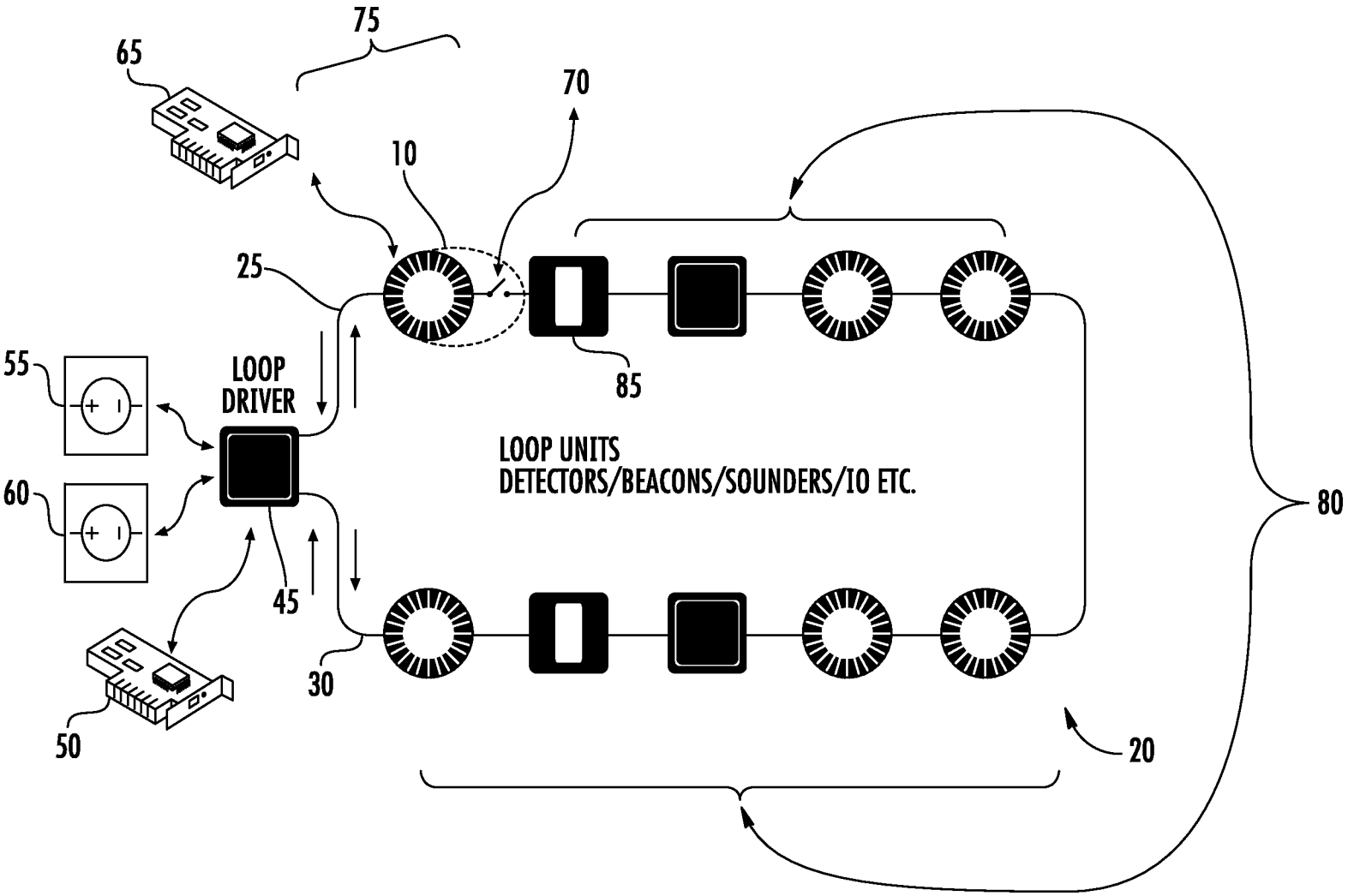
FIG. 1 illustrates a components of a detector circuit according to an embodiment.

Turning to FIG. 1 disclosed is a hazard detector 10 which may be electrically connected to a circuit 20. The circuit 20 may include a plurality of circuit ends including a first end 25 and a second end 30. The circuit 20 may include a plurality of detectors including the detector 10. The detector 10 may be connected intermediate the plurality of circuit ends.

The circuit 20 may include a circuit driver 45 connected to the plurality of circuit ends so that the circuit forms a loop circuit. The circuit 20 may further include a first controller 50 that may control, for example, a plurality of power sources including a first power source 55 and a second power source 60. The first power source 55 may selectively provide power to the first end 25 and the second power source 60 may selectively provide power to the second end 30. In an alternative embodiment power sources 55 and 60 may be the same power source, wherein the circuit driver 45 transmits the power from the single power source to the first and second outputs independently, and if desired simultaneously, using switches.

The detector 10, in contrast, may comprise a second controller 65 and a switch 70 which is a short isolator switch. When opened, the switch 70 may break electrical continuity downstream of the detector 10.

Figure 2:
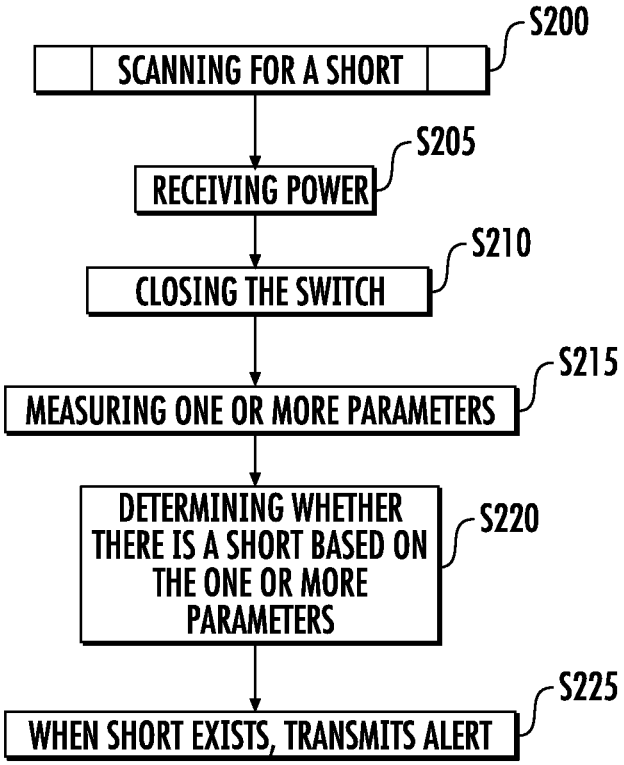
FIG. 2 illustrates steps performed by a detector during startup according to an embodiment.

Turning to FIG. 2, the detector 10 may perform step S200 of scanning for a short at startup. Step S200 may include step S205 of receiving power and step S210 of closing the switch 70. The detector 10 may then perform step S215 of measuring one or more circuit parameters, such as voltage. With this measurement the detector 10 may perform step S220 of determining whether there is a short. When there is a short, at step S225 the detector 10 may transmit a first circuit communication that identifies the short.

Figure 3:
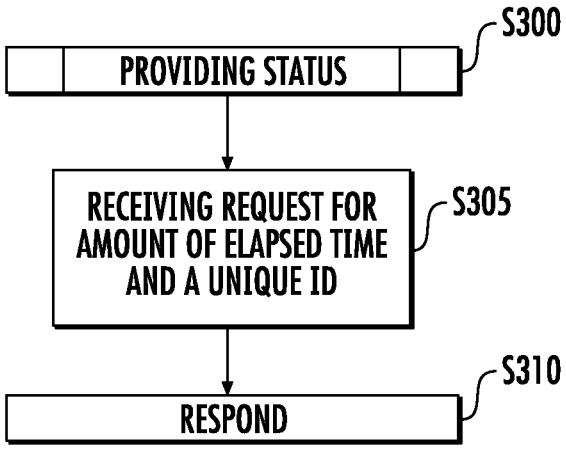
FIG. 3 illustrates further steps performed by a detector during startup according to an embodiment.

Turning to FIG. 3, if the detector 10 did not detect a short at startup the detector 10 may thereafter perform step S300 of providing status to the first controller 50. This status request may occur while other detectors in the circuit are starting up.

Step S300 may include step S305 of receiving a second circuit communication of requesting an amount of elapsed time since receiving power, for example as may be recorded on a counter. The request may also seek a unique detector identifier, such as a hardware address. The detector 10 at step S310 may transmit a third circuit communication responsive to the second circuit communication, which may include the amount of elapsed time and the unique detector identifier.

Figure 4:
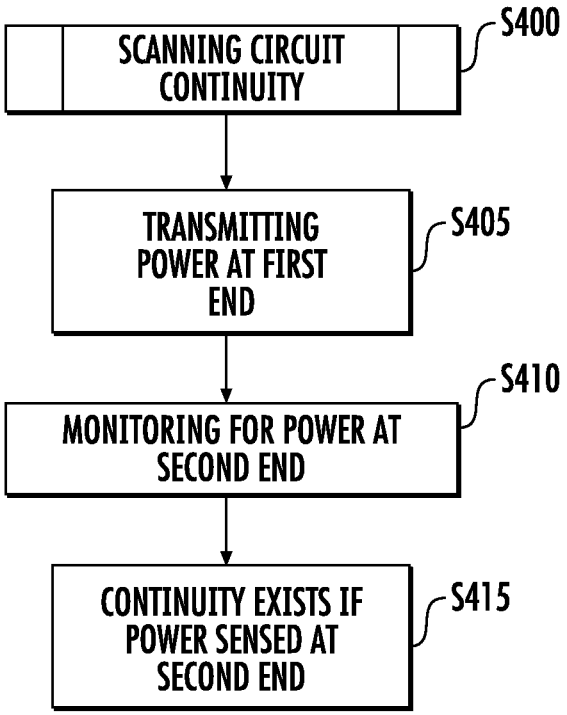
FIG. 4 illustrates steps performed by a loop driver during startup according to an embodiment.

Turning to FIG. 4, in contrast with the processes performed by the detector 10, during startup the circuit driver 45 may perform step S400 of scanning circuit continuity. Step S400 may include step S405 of transmitting power to the first end 25 and step S410 of monitoring the second end 30. When the circuit driver 45 senses power at the second end 30, the circuit driver 45 may perform step S415 of determining that circuit continuity exists.

Figure 5:
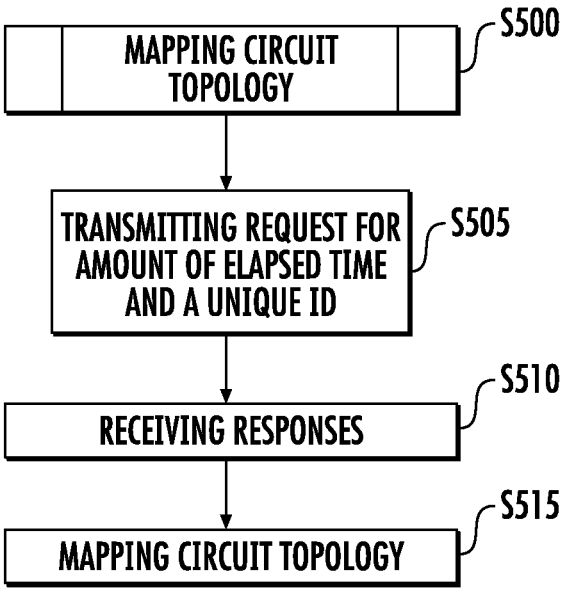
FIG. 5 illustrates further steps performed by a loop driver during startup according to an embodiment.

Turning to FIG. 5, when the circuit driver 45 determines continuity exists during startup, the circuit driver 45 may perform step S500 of mapping circuit topology. Step S500 may include step S505 of transmitting the second circuit communication from the first end 25. As indicated such communication may request from the plurality of detectors the amount of elapsed time since receiving power and the unique identifier for the detector 10. At step S510 the circuit driver 45 may receive, from each of the plurality of detectors, the third circuit communication responsive to the second circuit communication. The third circuit communication, as indicated, may include the amount of elapsed time and the unique detector identifier. At step S515 the circuit driver 45 may map circuit topology 20 based the unique detector identifiers and the elapsed time since receiving power.

Figure 6:
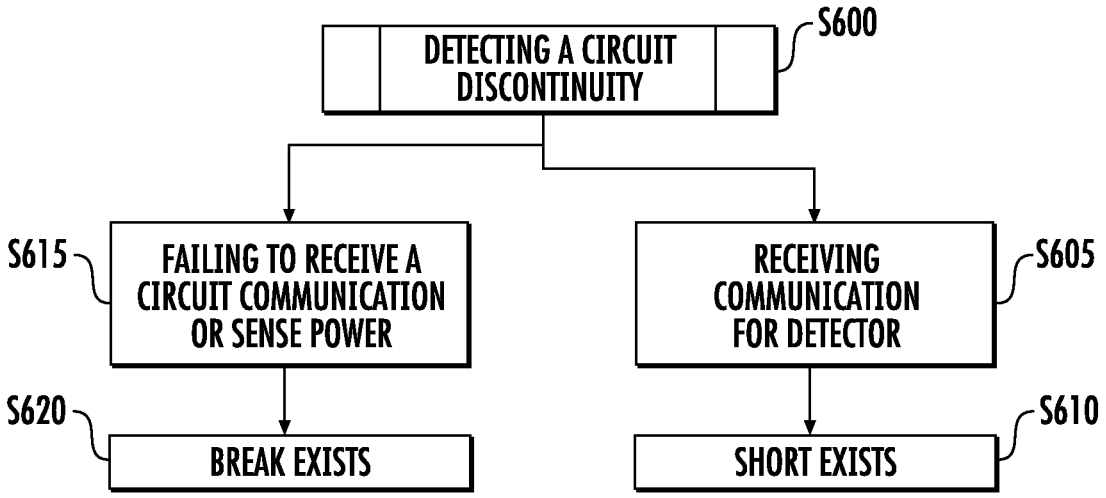
FIG. 6 illustrates further steps performed by a loop driver during startup according to an embodiment.

Turning to FIG. 6, the circuit driver 45 may perform step S600 of detecting circuit discontinuity at startup. Step S600 may include step S605 of receiving the first circuit communication at the first end 25 from the detector 10. From this the circuit driver 45 may perform step S610 of determining there is a circuit short. Alternatively at step S615 the circuit driver 45 may fail to receive a circuit communication or sense power at the second end 30 within a predetermined period of time. From this the circuit driver 45 may perform step S620 of determining there may be a circuit break.

Figure 7:
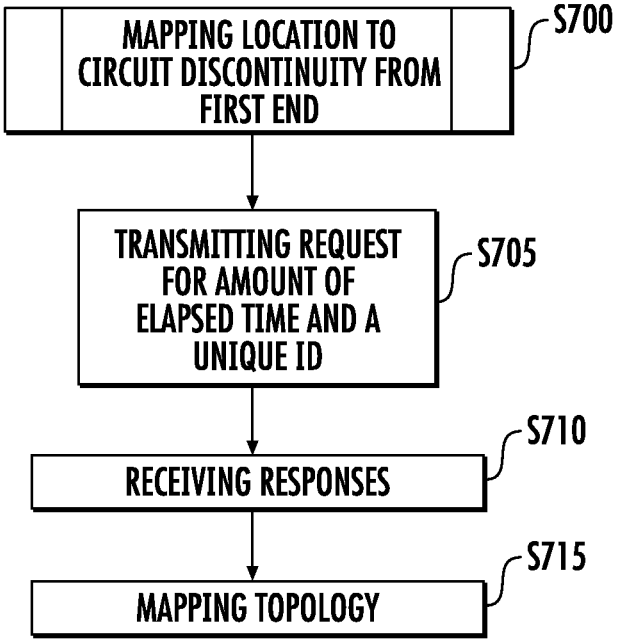
FIG. 7 illustrates further steps performed by a loop driver during startup according to an embodiment.

Turning to FIG. 7, when there is a circuit discontinuity, the circuit driver 45 may perform step S700 of mapping a first segment topology 75 (FIG. 1) of the circuit 20 from the first end 25 to the circuit discontinuity. Step S700 includes step S705 of transmitting the second circuit communication, requesting the amount of elapsed time since receiving power and the unique detector identifier. The circuit driver 45 may then perform step S710 of receiving the third circuit communication responsive to the second circuit communication, including the amount of elapsed time and the unique detector identifier. From this the circuit driver may performs step S715 of mapping a first segment topology 75 of the circuit 20 between the first end 25 and the discontinuity. The mapping of the first segment may be based the unique detector identifiers and the elapsed time since receiving power from the first end 25.

Figure 8:
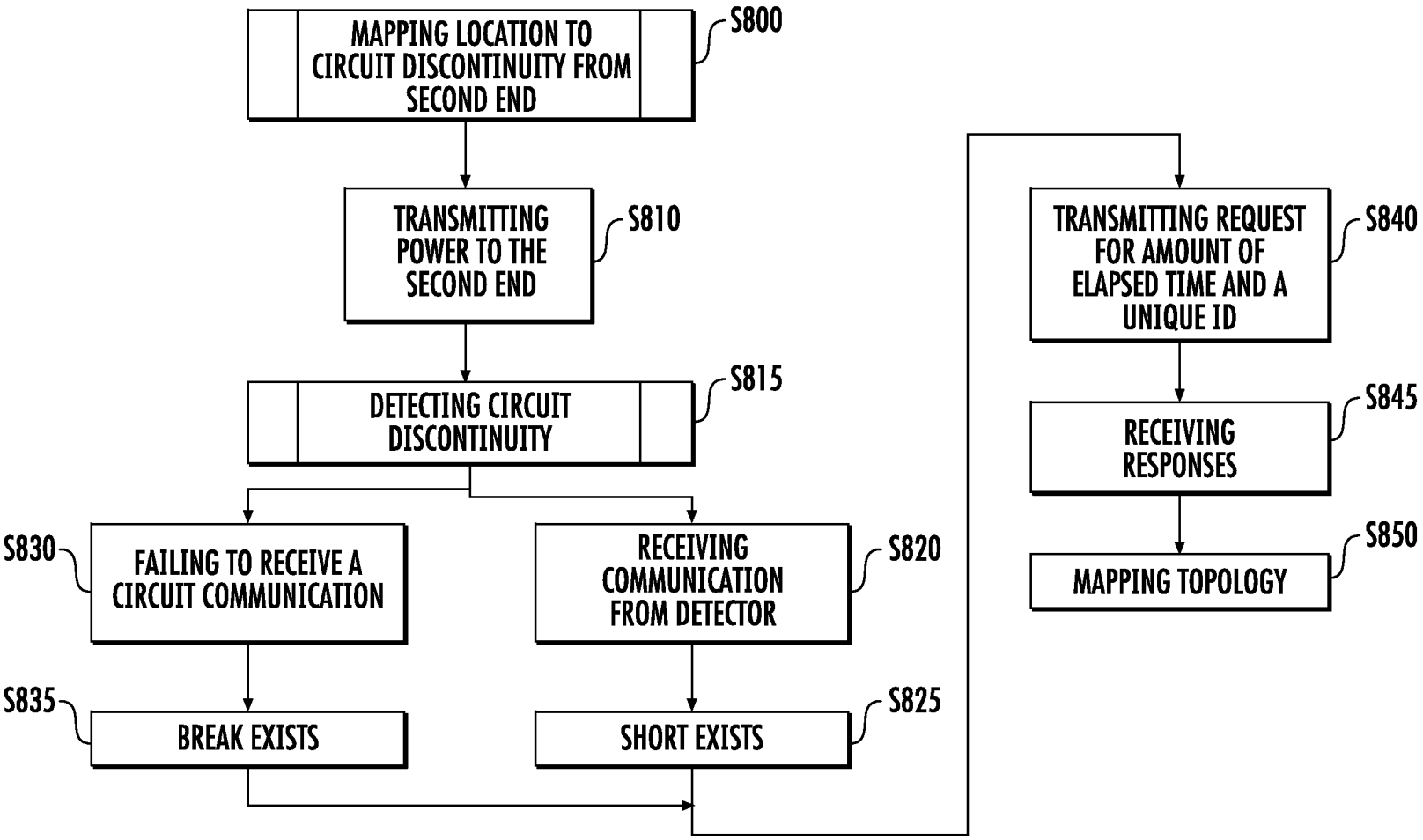
FIG. 8 illustrates further steps performed by a loop driver during startup according to an embodiment.

Turning to FIG. 8, in addition to mapping the first segment topology 75 the circuit driver 45 may perform step S800 of mapping a second segment topology 80 (FIG. 1) of the circuit 20 from the second end 30 to the circuit discontinuity. Step S800 may include step S810 of transmitting power to the second end 30. It is to be appreciated that power to the first end may continue because the detectors that have received power via that transmission route may remain powered and function as intended, that is, as hazard detectors.

With power at the second end 30, the circuit driver 45 may perform step S815 of detecting circuit discontinuity. Similar to the above step S600, step S815 may include step S820 of receiving the first circuit communication at the second end 30 from a second detector 85 (FIG. 1). Following step S820 the circuit driver 45 may perform step S825 of confirming there is a circuit short. Alternatively step S815 may include step S830 of the circuit driver 45 failing to receive a circuit communication within a predetermined period of time. From this the circuit driver 45 may perform step S835 of confirming there is a circuit break.

After confirming the discontinuity on the second end 30, the circuit driver 45 may perform step S840 of transmitting the second circuit communication, requesting the amount of elapsed time since receiving power and the unique detector identifier. The circuit driver 45 may then perform step S845 of receiving the third circuit communication responsive to the second circuit communication. As before such communication may include the amount of elapsed time and the unique detector identifier.

The circuit driver 45 may then perform step S850 of mapping the second segment topology 80 of the circuit 20 between the second end 30 and the discontinuity. As before the mapping may be based on the unique detector identifiers and the elapsed time since receiving power from the second end 30. With the mapped topologies the circuit driver 45 may determine a location of the circuit discontinuity by combining the mapped first segment topology 75 and mapped second segment topology 80 of the circuit 20.

Figure 9:
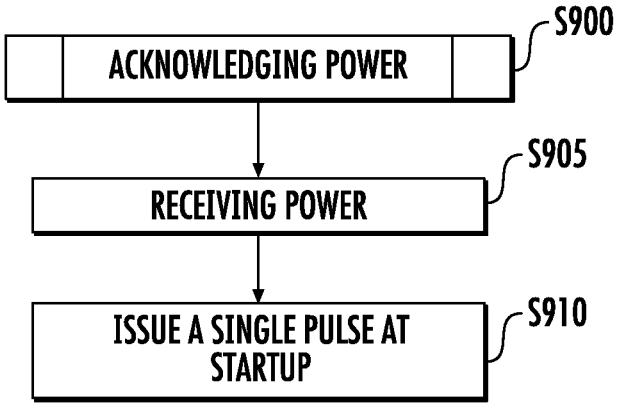
FIG. 9 illustrates further steps performed by a loop driver during startup according to an embodiment.

Turning to FIG. 9, in one embodiment the hazard detector 10 performs step S900 of acknowledging receiving power at startup. Step S900 includes step S905 of receiving power, and step S910 of issuing a single acknowledgment pulse at startup to the circuit 20. The pulse is intended to provide the circuit driver 45 with a confirmation that the detector 10 is powered.

Figure 10:
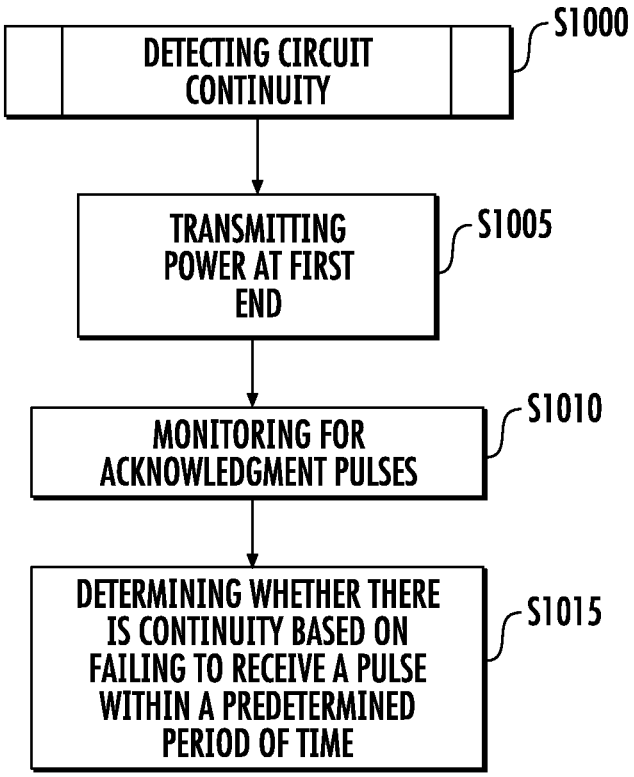
FIG. 10 illustrates further steps performed by a loop driver during startup according to an embodiment.

In contrast in FIG. 10, the circuit driver 45 performs step S1000 of detecting circuit continuity at startup. Step S1000 includes step S1005 of transmitting power to first end 25 and step S1010 of monitoring to receive from the plurality of detectors acknowledgment pulses. At step S1015 the circuit driver 45 determines whether there is continuity based on failing to receive an acknowledgement pulse within a predetermined period of time.

By adding the features of FIGS. 9 and 10 to the above disclosed embodiments, the loop driver may more rapidly determine whether there is an open circuit in the system. That is, while the detector can determine if there is a short based on active feedback from the detectors, a lack of response to the loop driver in the above embodiments is the step that enables the loop driver to determine there is an open circuit. The lack of response, however, may result in a relatively long wait before the loop driver makes the determination that a break exists in the circuit. With FIGS. 9 and 10, the loop driver may be able to determine whether there is an open circuit much more readily by failing to receive the acknowledgment pulse, for example, representing the successive powering up of each device in the circuit. This solution may be more rapid though less informative than other solutions provided herein.

It is to be appreciated that combining the above disclosed embodiments can be accomplished by changing step S205 to "receiving power and emitting a pulse". Similarly step S615 would recite "failing to receive a circuit communication, failing to receive a pulse within a predetermined period of time, or failing to sense power." Such modifications would subsume FIGS. 9 and 10 in the above disclosed embodiments.

Figure 11:
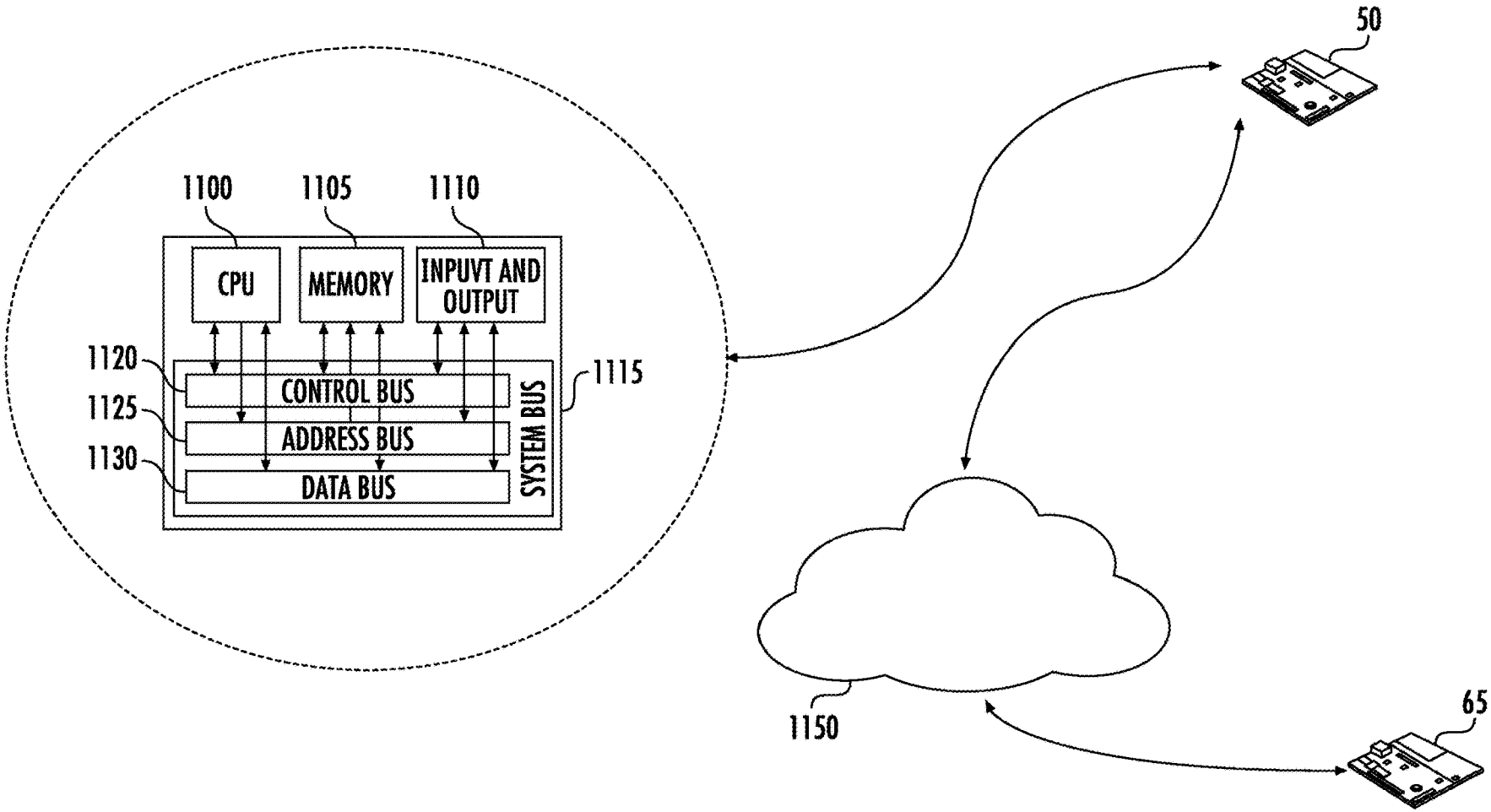
FIG. 11 illustrates technical features associated with one or more of the controllers disclosed in the application.

Turning now to FIG. 11, additional features of the controllers will be briefly disclosed. As indicated above, the controllers may include the first controller 50 and the second controller 65, which communicate over circuit which may be considered a form of a telecommunications network 1150. The plurality of controllers may have substantially the same technology features. Accordingly, features of the plurality of controllers may be disclosed hereinafter with reference to the first controller 50, which may be generally referred to hereinafter as controller 50.

The controller 50 may be a computing device that includes processing circuitry that may further include an application specific integrated circuit (ASIC), an electronic circuit with one or more elemental circuit components such as resistors, an electronic processor (shared, dedicated, or group) 1100 and memory 1105 that executes one or more software algorithms or firmware algorithms and programs, contains relevant data which may be dynamically collected or disposed in one or more look-up tables, a combinational logic circuit that contains one or more operational amplifiers, and/or other suitable interfaces and components that provide the described functionality. For example, the processor 1100 processes data stored in the memory 1105 and employs the data in various control algorithms, diagnostics and the like.

The controller 50 may further include, in addition to a processor 1100 and memory 1105, one or more input and/or output (I/O) device interface(s) 1110 that are communicatively coupled via an onboard (local) interface to communicate among the plurality of controllers. The onboard interface may include, for example but not limited to, an onboard system bus 1115, including a control bus 1120 (for inter-device communications), an address bus 1125 (for physical addressing) and a data bus 1130 (for transferring data). That is, the system bus 1115 enables the electronic communications between the processor 1100, memory 1105 and I/O connections 1110. The I/O connections 1110 may also include wired connections and/or wireless connections. The onboard interface may have additional elements, which are omitted for simplicity, such as controllers, buffers (caches), drivers, repeaters, and receivers to enable electronic communications.

In operation, the processor 1100 onboard the controller 50 may be configured to execute software algorithms stored within the memory 1105, to communicate data to and from the memory 1105, and to generally control computing operations pursuant to the software algorithms. The algorithms in the memory 1105, in whole or in part, may be read by the processor 1100, perhaps buffered within the processor 1100, and then executed. The processor 1100 may include hardware devices for executing the algorithms, particularly algorithms stored in memory 1105. The processor 1100 may be a custom made or a commercially available processor 1100, a central processing units (CPU), an auxiliary processor among several processors associated with computing devices, semiconductor based microprocessors (in the form of microchips or chip sets), or generally any such devices for executing software algorithms.

The memory 1105 onboard the controller 50 may include any one or combination of volatile memory elements (e.g., random access memory (RAM, such as DRAM, SRAM, SDRAM, VRAM, etc.)) and/or nonvolatile memory elements (e.g., ROM, hard drive, tape, CD-ROM, etc.). Moreover, the memory 1105 may incorporate electronic, magnetic, optical, and/or other types of storage media. The memory 1105 may also have a distributed architecture, where various components are situated remotely from one another, but may be accessed by the processor 1100.

The software algorithms in the memory 1105 onboard the controller 50 may include one or more separate programs, each of which includes an ordered listing of executable instructions for implementing logical functions. A system component embodied as software algorithms may be construed as a source program, executable program (object code), script, or any other entity comprising a set of instructions to be performed. When constructed as a source program, the software algorithms may be translated via a compiler, assembler, interpreter, or the like, which may or may not be included within the memory.

Some of the input/output (I/O) devices that may be coupled to the controller 50 using the system I/O Interface(s) 1110, the wired interfaces and/or the wireless interfaces will now be identified but the illustration of which shall be omitted for brevity. Such I/O devices include, but are not limited to (i) input devices such as a keyboard, mouse, scanner, microphone, camera, proximity device, etc., (ii) output devices such as a printer, display, etc., and (iii) devices that communicate both as inputs and outputs, such as a modulator/demodulator (modem; for accessing another device, system, or network), a radio frequency (RF) or other transceiver, a telephonic interface, a bridge, a router, etc.

Further, using the wireless connection, the controller 50 may communicate over the network 54 by applying electronic short range communication (SRC) protocols. Such protocols may include local area network (LAN) protocols and/or a private area network (PAN) protocols. LAN protocols include Wi-Fi technology, which is a technology based on the Section 802.11 standards from the Institute of Electrical and Electronics Engineers, or IEEE. PAN protocols include, for example, Bluetooth Low Energy (BTLE), which is a wireless technology standard designed and marketed by the Bluetooth Special Interest Group (SIG) for exchanging data over short distances using short-wavelength radio waves. PAN protocols also include Zigbee, a technology based on Section 802.15.4 protocols from the Institute of Electrical and Electronics Engineers (IEEE). More specifically, Zigbee represents a suite of high-level communication protocols used to create personal area networks with small, low-power digital radios for low-power low-bandwidth needs, and is best suited for small scale projects using wireless connections. Such wireless connection 1130 may include Radio-frequency identification (RFID) technology, which is another SRC technology used for communicating with an integrated chip (IC) on an RFID smartcard.

One should note that the above disclosed architecture, functionality, and/or hardware operations of the controller 50 may be implemented using software algorithms. In the software algorithms, such functionality may be represented as a module, segment, or portion of code, which comprises one or more executable instructions for implementing the specified logical function(s). It should also be noted that such modules may not necessarily be executed in any particular order and/or executed at all.

One should also note that any of the functionality of the controller 50 described herein can be embodied in any non-transitory computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" contains, stores, communicates, propagates and/or transports the program for use by or in connection with the instruction execution system, apparatus, or device.

Further, the computer readable medium in the controller 50 may include various forms of computer readable memory 1105. For example the computer readable memory 1105 may be integral to an apparatus or device, which may include one or more semiconductors, and in which the communication and/or storage technology may be one or more of electronic, magnetic, optical, electromagnetic or infrared. More specific examples (a non-exhaustive list) of a computer-readable medium the illustration of which being omitted for brevity include a portable computer diskette (magnetic), a random access memory (RAM) (electronic), a read-only memory (ROM) (electronic), an erasable programmable read-only memory (EPROM or Flash memory) (electronic), and a portable compact disc read-only memory (CDROM) (optical).

In addition, the above distributed system of controllers is not intended to be limiting. In one embodiment, each of the controllers on the same side of the network may be the same device such that no network therebetween is required. In one embodiment a single on-site controller is provided instead of the distributed system of controllers. In one embodiment the controllers on the same side of the network are controlled by servers located over the World Wide Web, using a cloud computing configuration. In one embodiment, the distributed controller network is hard-wired for all telecommunication services so that no wireless network is necessary. In one embodiment redundant wireless and wired networks are utilized which automatically switch between such services to minimize network congestion.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A hazard detector electrically connected to a circuit, wherein the circuit includes:

a plurality of circuit ends including a first end and a second end, and a plurality of detectors including the detector, wherein the detector is connected intermediate the plurality of circuit ends, a circuit driver connected to the plurality of circuit ends so that the circuit forms a loop circuit, the circuit driver including a first controller controlling one or more power sources to selectively provide power to the first end and the second end, and the detector comprising a second controller and a switch which is a short isolator switch that, when opened, breaks electrical continuity downstream of the detector, wherein the detector scans for a short at startup by receiving power, closing the switch, measuring one or more circuit parameters, and determining whether there is a short based on the one or more circuit parameters, when there is a short, the detector transmits a first circuit communication that identifies the short;

wherein the detector when powered provides status by:

receiving a second circuit communication requesting an amount of elapsed time since receiving power and a unique detector identifier, and transmitting a third circuit communication responsive to the second circuit communication, including the amount of elapsed time and the unique detector identifier.

2. A circuit comprising:

the plurality of circuit ends including the first end and the second end, and a plurality of detectors including the detector of claim 1, connected intermediate the plurality of circuit ends, the circuit driver connected to the plurality of circuit ends so that the circuit forms the loop circuit, the circuit driver including the first controller controlling one or more power sources to selectively provide power to the first end and the second end, and wherein the circuit driver scans circuit continuity during startup by:

transmitting power to the first end, monitoring the second end, and when the circuit driver senses power at the second end, the circuit driver determines continuity exists.

3. The circuit of claim 2, wherein when the circuit driver determines continuity exists, the circuit driver maps circuit topology by:

transmitting the second circuit communication from the first end, requesting from the plurality of detectors the amount of elapsed time since receiving power and the unique detector identifier for the detector, receiving, from each of the plurality of detectors, the third circuit communication responsive to the second circuit communication, including the amount of elapsed time and the unique detector identifier, and mapping circuit topology based the unique detector identifier and the amount of elapsed time since receiving power.

4. The circuit of claim 2, wherein the circuit driver detects circuit discontinuity at startup by receiving the first circuit communication at the first end from the detector, thereby determining there is a circuit short, and failing to receive a circuit communication or sense power at the second end within a predetermined period of time, thereby determining there is a circuit break.

5. The circuit of claim 2, wherein when there is a circuit discontinuity, the circuit driver maps a first segment topology of the circuit from the first end to the circuit discontinuity by transmitting the second circuit communication, requesting the amount of elapsed time since receiving power and the unique detector identifier, receiving the third circuit communication responsive to the second circuit communication, including the amount of elapsed time and the unique detector identifier and mapping the first segment topology of the circuit between the first end and the circuit discontinuity based the unique detector identifier and the amount of elapsed time since receiving power from the first end.

6. The circuit of claim 4, wherein when there is the circuit discontinuity, the circuit driver maps a second segment topology of the circuit from the second end to the circuit discontinuity by transmitting power to the second end, detecting the circuit discontinuity through the second end by receiving the first circuit communication at the second end from a second detector, thereby confirming there is the circuit short, or failing to receive the circuit communication within the predetermined period of time, thereby confirming there is the circuit break, transmitting the second circuit communication, requesting the amount of elapsed time since receiving power and the unique detector identifier, receiving the third circuit communication responsive to the second circuit communication, including the amount of elapsed time and the unique detector identifier, and mapping the second segment topology of the circuit between the second end and the circuit discontinuity based the unique detector identifier and the amount of elapsed time since receiving power from the second end.

7. The circuit of claim 4, wherein the circuit driver determines a location of the circuit discontinuity combining the mapped first segment topology and mapped second segment topology of the circuit.

8. The circuit of claim 2, wherein the detector acknowledges receiving power at startup by issuing an acknowledgment pulse to the circuit.

9. The circuit of claim 4, wherein the detector scans for the circuit break at startup by failing to receive an acknowledgement pulse within the predetermined period of time.

10. A method of scanning for a short at startup by a hazard detector electrically connected to a circuit, wherein the circuit includes:

a plurality of circuit ends including a first end and a second end, and a plurality of detectors including the detector, wherein the detector is connected intermediate the plurality of circuit ends, a circuit driver connected to the plurality of circuit ends so that the circuit forms a loop circuit, the circuit driver including a first controller controlling one or more power sources to selectively provide power to the first end and the second end, and the detector comprising a second controller and a switch which is a short isolator switch that, when opened, breaks electrical continuity downstream of the detector, wherein the method comprises receiving power, closing the switch, measuring one or more circuit parameters, and determining whether there is a short based on the one or more circuit parameters, when there is a short, the detector transmits a first circuit communication that identifies the short, wherein the detector when powered provides status by:

receiving a second circuit communication requesting an amount of elapsed time since receiving power and a unique detector identifier, and transmitting a third circuit communication responsive to the second circuit communication, including the amount of elapsed time and the unique detector identifier.

11. A method of scanning circuit continuity at startup by the circuit driver electrically connected to a circuit, wherein the circuit includes:

the plurality of circuit ends including the first end and the second end, and a plurality of detectors including the detector of claim 10, connected intermediate the plurality of circuit ends, the circuit driver connected to the plurality of circuit ends so that the circuit forms the loop circuit, the circuit driver including the first controller controlling one or more power sources to selectively provide power to the first end and the second end, and wherein the method comprises transmitting power to the first end, monitoring the second end, and when the circuit driver senses power at the second end, the circuit driver determines continuity exists.

12. The method of claim 11, wherein when the circuit driver determines continuity exists, the circuit driver maps circuit topology by:

transmitting the second circuit communication from the first end, requesting from the plurality of detectors the amount of elapsed time since receiving power and the unique detector identifier for the detector, receiving, from each of the plurality of detectors, the third circuit communication responsive to the second circuit communication, including the amount of elapsed time and the unique detector identifier, and mapping circuit topology based the unique detector identifier and the amount of elapsed time since receiving power.

13. The method of claim 11, wherein the circuit driver detects circuit discontinuity at startup by receiving the first circuit communication at the first end from the detector, thereby determining there is a circuit short, and failing to receive a circuit communication or sense power at the second end within a predetermined period of time, thereby determining there is a circuit break.

14. The method of claim 11, wherein when there is a circuit discontinuity, the circuit driver maps a first segment topology of the circuit from the first end to the circuit discontinuity by transmitting the second circuit communication, requesting the amount of elapsed time since receiving power and the unique detector identifier, receiving the third circuit communication responsive to the second circuit communication, including the amount of elapsed time and the unique detector identifier and mapping the first segment topology of the circuit between the first end and the circuit discontinuity based the unique detector identifier and the amount of elapsed time since receiving power from the first end.

15. The method of claim 13, wherein when there is the circuit discontinuity, the circuit driver maps a second segment topology of the circuit from the second end to the circuit discontinuity by transmitting power to the second end, detecting the circuit discontinuity through the second end by receiving the first circuit communication at the second end from a second detector, thereby confirming there is the circuit short, or failing to receive the circuit communication within the predetermined period of time, thereby confirming there is the circuit break, transmitting the second circuit communication, requesting the amount of elapsed time since receiving power and the unique detector identifier, receiving the third circuit communication responsive to the second circuit communication, including the amount of elapsed time and the unique detector identifier, and mapping the second segment topology of the circuit between the second end and the circuit discontinuity based the unique detector identifier and the amount of elapsed time since receiving power from the second end.

16. The method of claim 13, wherein the circuit driver determines a location of the circuit discontinuity combining the mapped first segment topology and mapped second segment topology of the circuit.

17. The method of claim 11, wherein the detector acknowledges receiving power at startup by issuing an acknowledgment pulse to the circuit.

18. The method of claim 13, wherein the detector scans for the circuit break at startup by failing to receive an acknowledgement pulse within the predetermined period of time.

* * * * *